US006078669A

United States Patent [19]

Maher

[11] Patent Number: 6,078,669

[45] Date of Patent: Jun. 20, 2000

[54] AUDIO SPATIAL LOCALIZATION APPARATUS AND METHODS

[75] Inventor: Robert Crawford Maher, Boulder, Colo.

[73] Assignee: EuPhonics, Incorporated, Boulder, Colo.

[21] Appl. No.: 08/896,283

[22] Filed: Jul. 14, 1997

[51] Int. Cl.[7] ..... H04R 5/00

[52] U.S. Cl. ..... 381/17; 381/63

[58] Field of Search ..... 381/17, 18, 1, 381/61, 63, 27

[56] References Cited

U.S. PATENT DOCUMENTS

| | | | |
|---|---|---|---|
| 3,236,949 | 2/1966 | Atal et al. . | |
| 4,219,696 | 8/1980 | Kogure et al. . | |
| 4,748,669 | 5/1988 | Klayman . | |
| 4,817,149 | 3/1989 | Myers | 381/1 |
| 4,841,572 | 6/1989 | Klayman . | |
| 5,027,687 | 7/1991 | Iwamatsu | 381/18 |
| 5,046,097 | 9/1991 | Lowe et al. . | |
| 5,052,685 | 10/1991 | Lowe et al. . | |
| 5,121,433 | 6/1992 | Kendall et al. . | |
| 5,235,646 | 8/1993 | Wilde et al. . | |
| 5,371,799 | 12/1994 | Lowe et al. | 381/17 |
| 5,386,082 | 1/1995 | Higashi . | |
| 5,412,731 | 5/1995 | Desper . | |
| 5,436,975 | 7/1995 | Lowe et al. . | |
| 5,438,623 | 8/1995 | Begault . | |
| 5,440,639 | 8/1995 | Suzuki et al. | 381/17 |
| 5,467,401 | 11/1995 | Nagamitsu et al. | 381/17 |
| 5,521,981 | 5/1996 | Gehring . | |
| 5,555,306 | 9/1996 | Gerzon | 381/63 |
| 5,587,936 | 12/1996 | Levitt et al. . | |
| 5,684,881 | 11/1997 | Serikawa et al. | 381/17 |
| 5,742,688 | 4/1998 | Ogawa et al. | 381/17 |

*Primary Examiner*—Ping Lee
*Attorney, Agent, or Firm*—Jennifer L. Bales; Macheledt Bales & Johnson LLP

[57] ABSTRACT

Audio spatial localization is accomplished by utilizing input parameters representing the physical and geometrical aspects of a sound source to modify a monophonic representation of the sound or voice and generate a stereo signal which simulates the acoustical effect of the localized sound. The input parameters include location and velocity, and may also include directivity, reverberation, and other aspects. The input parameters are used to generate control parameters which control voice processing. Thus, each voice is Doppler shifted, separated into left and right channels, equalized, and one channel is delayed, according to the control parameters. In addition, the left and right channels may be separated into front and back channels, which are separately processed to simulate front and back location and motion. The stereo signals may be fed into headphones, or may be fed into a crosstalk cancellation device for use with loudspeakers.

16 Claims, 10 Drawing Sheets

AUDIO SPATIAL LOCALIZATION APPARATUS AND METHODS

BACKGROUND OF THE INVENTION

1. Field of the Invention

The present invention relates to apparatus and methods for simulating the acoustical effects of a localized sound source.

2. Description of the Prior Art

Directional audio systems for simulating sound source localization are well known to those skilled in audio engineering. Similarly, the principal mechanisms for sound source localization by human listeners have been studied systematically since the early 1930's. The essential aspects of source localization consist of the following features or cues:

1) Interaural time difference—the difference in arrival times of a sound at the two ears of the listener, primarily due to the path length difference between the sound source and each of the ears.
2) Interaural intensity difference—the difference in sound intensity level at the two ears of the listener, primarily due to the shadowing effect of the listener's head.
3) Head diffraction—the wave behavior of sound propagating toward the listener involves diffraction effects in which the wavefront bends around the listener's head, causing various frequency dependent interference effects.
4) Effects of pinnae—the external ear flap (pinna) of each ear produces high frequency diffraction and interference effects that depend upon both the azimuth and elevation of the sound source.

The combined effects of the above four cues can be represented as a Head Related Transfer Function (HRTF) for each ear at each combination of azimuth and elevation angles. Other cues due to normal listening surroundings include discrete reflections from nearby surfaces, reverberation, Doppler and other time variant effects due to relative motion between source and listener, and listener experience with common sounds.

A large number of studio techniques have been developed in order to provide listeners with the impression of spatially distributed sound sources. Refer, for example, to "Handbook of Recording Engineering" by J. Eargle, New York: Van Nostrand Reinhold Company, Inc., 1986 and "The Simulation of Moving Sound Sources" by J. Chowning, J. Audio Eng. Soc., vol. 19, no. 1, pp. 2–6, 1971.

Additional work has been performed in the area of binaural recording. Binaural methods involve recording a pair of signals that represent as closely as possible the acoustical signals that would be present at the ears of a real listener. This goal is often accomplished in practice by placing microphones at the ear positions of a mannequin head. Thus, naturally occurring time delays, diffraction effects, etc., are generated acoustically during the recording process. During playback, the recorded signals are delivered individually to the listener's ears, by headphones, for example, thus retaining directional information in the recording environment.

A refinement of the binaural recording method is to simulate the head related effects by convolving the desired source signal with a pair of measured or estimated head related transfer functions. See, for example U.S. Pat. No. 4,188,504 by Kasuga et al. and U.S. Pat. No. 4,817,149 by Myers.

The two channel spatial sound localization simulation systems heretofore known exhibit one or more of the following drawbacks:

1) The existing schemes either use extremely simple models which are efficient to implement but provide imprecise localization impressions, or extremely complicated models which are impractical to implement.
2) The artificial localization algorithms are often suitable only for headphone listening.
3) Many existing schemes rely on ad hoc parameters which cannot be derived from the physical orientation of the source and the listener.
4) Simulation of moving sound sources requires either extensive parameter interpolation or extensive memory for stored sets of coefficients.

A need remains in the art for a straightforward localization model which uses control parameters representing the geometrical relationship between the source and the listener to create arbitrary sound source locations and trajectories in a convenient manner.

SUMMARY OF THE INVENTION

An object of the present invention is to provide audio spatial localization apparatus and methods which use control parameters representing the geometrical relationship between the source and the listener to create arbitrary sound source locations and trajectories in a convenient manner.

The present invention is based upon established and verifiable human psychoacoustical measurements so that the strengths and weaknesses of the human hearing apparatus may be exploited. Precise localization in the horizontal plane intersecting the listener's ears is of greatest perceptual importance. Therefore, the computational cost of this invention is dominated by the azimuth cue processing. The system is straightforward for convenient implementation in digital form using special purpose hardware or a programmable architecture. Scaleable processing algorithms are used, which allows the reduction of computational complexity with minimal audible degradation of the localization effect. The system operates successfully for both headphones and speaker playback, and operates properly for all listeners regardless of the physical dimensions of the listener's pinnae, head, and torso.

The present spatial localization invention provides a set of audible modifications which produce the impression that a sound source is located at a particular azimuth, elevation and distance relative to the listener. In a preferred embodiment of this invention, the input signal to the apparatus is a single channel (monophonic) recording or simulation of each desired sound source, together with control parameters representing the position and physical aspects of each source. The output of the apparatus is a two channel (stereophonic) pair of signals presented to the listener via conventional loudspeakers or headphones. If loudspeakers are used, the invention includes a crosstalk cancellation network to reduce signal leakage from the left loudspeaker into the right ear and from the right loudspeaker into the left ear.

The present invention has been developed by deriving the correct interchannel amplitude, frequency, and phase effects that would occur in the natural environment for a sound source moving with a particular trajectory and velocity relative to a listener. A parametric method is employed. The parameters provided to the localization algorithm describe explicitly the required directional changes for the signals arriving at the listener's ears. Furthermore, the parameters are easily interpolated so that simulation of arbitrary movements can be performed within tight computational limitations.

Audio spatial localization apparatus for generating a stereo signal which simulates the acoustical effect of a plurality of localized sounds includes means for providing an audio signal representing each sound, means for providing a set of input parameters representing the desired physical and geometrical attributes of each sound, front end means for generating a set of control parameters based upon each set of input parameters, voice processing means for modifying each audio signal according to its associated set of control parameters to produce a voice signal which simulates the effect of the associated sound with the desired physical and geometrical attributes, and means for combining the voice signals to produce an output stereo signal including a left channel and a right channel.

The audio spatial localization apparatus may further include crosstalk cancellation apparatus for modifying the stereo signal to account for crosstalk. The crosstalk cancellation apparatus includes means for splitting the left channel of the stereo signal into a left direct channel and a left cross channel, means for splitting the right channel of the stereo signal into a right direct channel and a right cross channel, nonrecursive left cross filter means for delaying, inverting, and equalizing the left cross channel to cancel initial accoustic crosstalk in the right direct channel, nonrecursive right cross filter means for delaying, inverting, and equalizing the right cross channel to cancel initial accoustic crosstalk in the left direct channel, means for summing the right direct channel and the left cross channel to form a right initial-crosstalk-canceled channel, and means for summing the left direct channel and the right cross channel to form a left initial-crosstalk-canceled channel.

The crosstalk apparatus may further comprise left direct channel filter means for canceling subsequent delayed replicas of crosstalk in the left initial-crosstalk-canceled channel to form a left output channel, and right direct channel filter means for canceling subsequent delayed replicas of crosstalk in the right initial-crosstalk-canceled channel to form a right output channel. As a feature, the crosstalk apparatus may also include means for additionally splitting the left channel into a third left channel, means for low pass filtering the third left channel, means for additionally splitting the right channel into a third right channel, means for low pass filtering the third right channel, means for summing the low pass filtered left channel with the left output channel, and means for summing the low pass filtered right channel with the right output channel.

The nonrecursive left cross filter and the nonrecursive right cross filter may comprise FIR filters. The left direct channel filter and the right direct channel filter may comprise recursive filters, such as IIR filters.

The crosstalk cancellation input parameters include parameters representing source location and velocity and the control parameters include a delay parameter and a Doppler parameter. The voice processing means includes means for Doppler frequency shifting each audio signal according to the Doppler parameter, means for separating each audio signal into a left and a right channel, and means for delaying either the left or the right channel according to the delay parameter.

The control parameters further include a front parameter and a back parameter, and the voice processing means further comprises means for separating the left channel into a left front and a left back channel, means for separating the right channel into a right front and a right back channel, and means for applying gains to the left front, left back, right front, and right back channels according to the front and back control parameters.

The voice processing means further comprises means for combining all of the left back channels for all of the voices and decorrelating them, means for combining all of the right back channels for all of the voices and decorrelating them, means for combining all of the left front channels with the decorrelated left back channels to form the left stereo signal, and means for combining all of the right front channels with the decorrelated right back channels to form the right stereo signal.

The input parameters include a parameter representing directivity and the control parameters include left and right filter and gain parameters. The voice processing means further comprises left equalization means for equalizing the left channel according to the left filter and gain parameters, and right equalization means for equalizing the right channel according to the right filter and gain parameters.

Audio spatial localization apparatus for generating a stereo signal which simulates the acoustical effect of a plurality of localized sounds comprises means for providing an audio signal representing each sound, means for providing a set of input parameters representing desired physical and geometrical attributes of each sound, front end means for generating a set of control parameters based upon each set of input parameters, and voice processing means. The voice processing means for producing processed signals includes separate processing means for modifying each audio signal according to its associated set of control parameters, and combined processing means for combining portions of the audio signals to form a combined audio signal and processing the combined signal. The processed signals are combined to produce an output stereo signal including a left channel and a right channel.

The sets of control parameters include a reverberation parameter and the separate processing includes means for splitting the audio signal into a first path for further separate processing and a second path, and means for scaling the second path according to the reverberation parameter. The combined processing includes means for combining the scaled second paths and means for applying reverberation to the combination to form a reverberant signal.

The sets of control parameters also include source location parameters, a front parameter and a back parameter. The separate processing further includes means for splitting the audio signal into a right channel and a left channel according to the source location parameters, means for splitting the right channel and the left channel into front paths and back paths, and means for scaling the front and back paths according to the front and back parameters. The combined processing includes means for combining the scaled left back paths and decorrelating the combined left back paths, means for combining the right back paths and decorrelating the right back paths, means for combining the combined, decorrelated left back paths with the left front paths, and means for combining the combined, decorrelated right back paths with the right front paths to form the output stereo signal.

DETAILED DESCRIPTION OF THE PREFERRED EMBODIMENT

Figure 1:
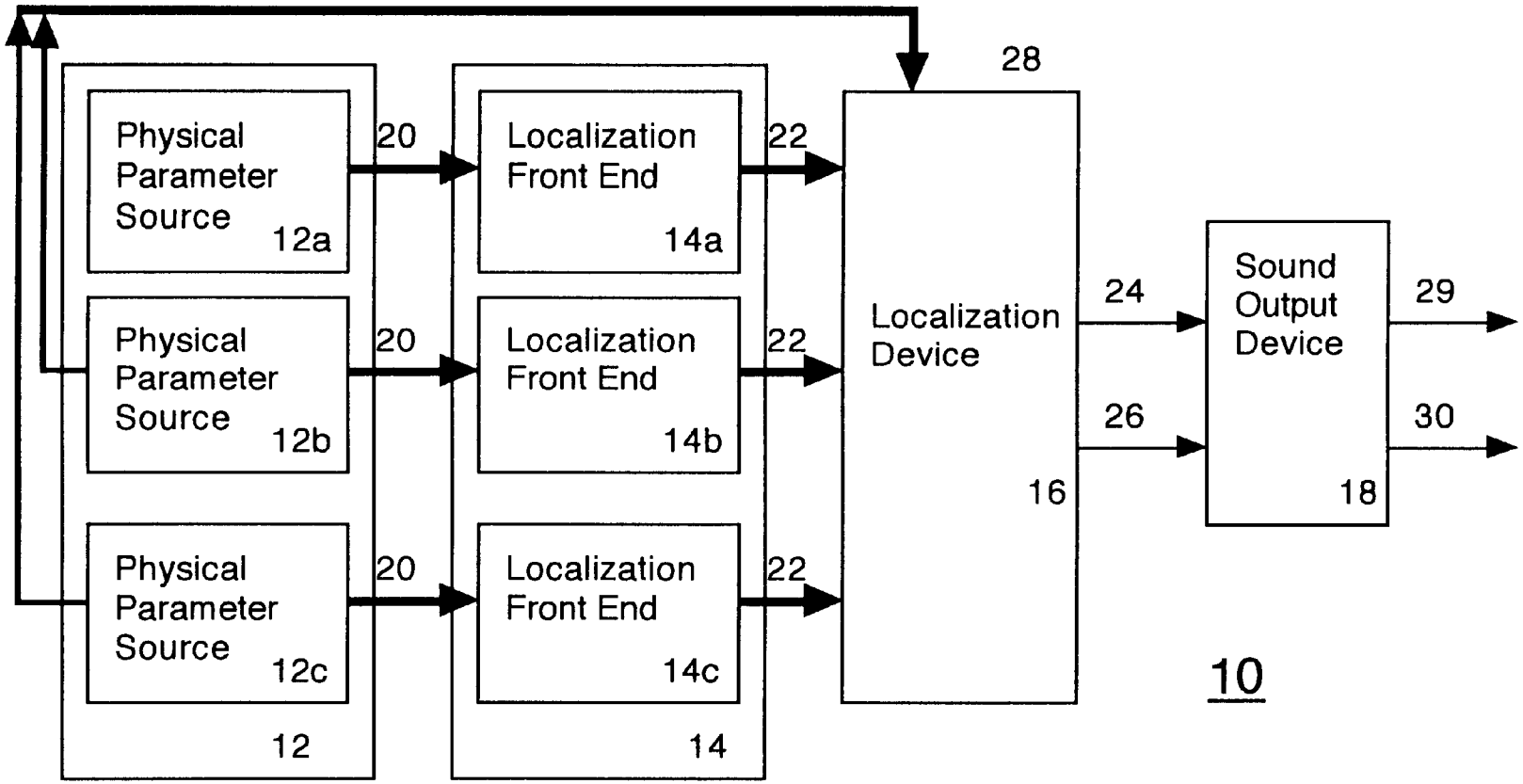
FIG. 1 shows audio spatial localization apparatus according to the present invention.

FIG. 1 shows audio spatial localization apparatus 10 according to the present invention. As an illustrative example, the localization of three sound sources, or voices, 28 is shown. Physical parameter sources 12*a*, 12*b*, and 12*c* provide physical and geometrical parameters 20 to localization front end blocks 14*a*, 14*b*, and 14*c*, as well as providing the sounds or voices 28 associated with each source 12 to localization block 16. Localization front end blocks 14*a–c* compute sound localization control parameters 22, which are provided to localization block 16. Voices 28 are also provided to localization block 16, which modifies the voices to approximate the appropriate directional cues of each according to localization control parameters 22. The modified voices are combined to form a right output channel 24 and left output channel 26 to sound output device 18. Output signals 29 and 30 might comprise left and right channels provided to headphones, for example.

For the example of a computer game, physical and geometrical parameters 20 are provided by the game environment 12 to specify sound sources within the game. The game application has its own three dimensional model of the desired environment and a specified location for the game player within the environment. Part of the model relates to the objects visible on the screen and part of the model relates to the sonic environment, i.e., which objects make sounds, with what directional pattern, what reverberation or echoes are present, and so forth. The game application passes physical and geometrical parameters 20 to a device driver, comprising localization front end 14 and localization device 16. This device driver drives the sound processing apparatus of the computer, which is sound output device 18 in FIG. 1. Devices 14 and 16 may be implemented as software, hardware, or some combination of hardware and software. Note also that the game application can provide either the physical parameters 20 as described above, or the localization control parameters 22 directly, should this be more suitable to a particular implementation.

Figure 2:
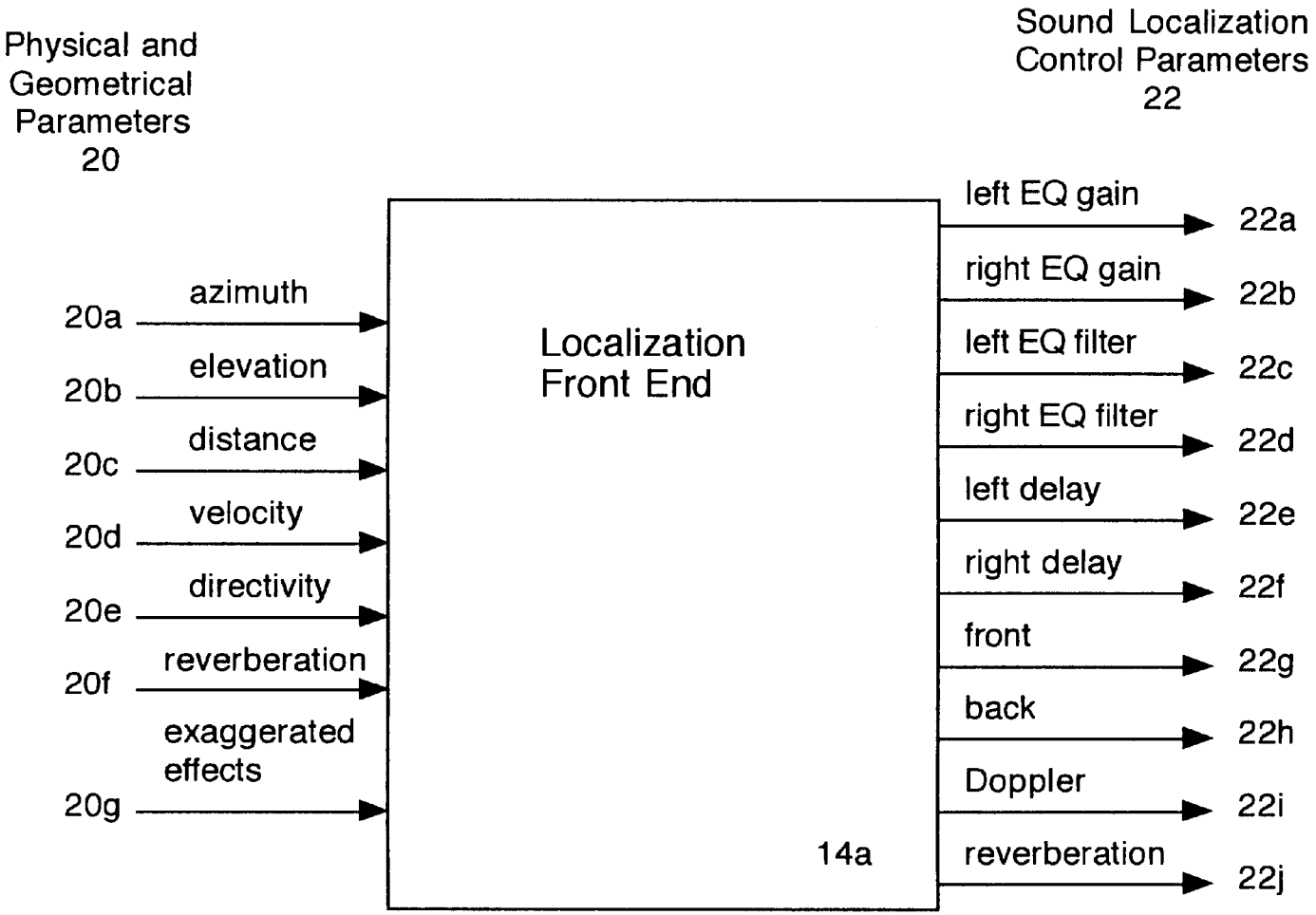
FIG. 2 shows the input parameters and output parameters of the localization front end blocks of FIG. 1.

FIG. 2 shows the input parameters 20 and output parameters 22 of one localization front end block 14*a*. Input parameters 20 describe the geometrical and physical aspects of each voice. In the present example, the parameters comprise azimuth 20*a*, elevation 20*b*, distance 20*c*, velocity 20*d*, directivity 20*e*, reverberation 20*f*, and exaggerated effects 20*g*. Azimuth 20*a*, elevation 20*b*, and distance 20*c* are generally provided, although x, y, and z parameters may also be used. Velocity 20*d* indicates the speed and direction of the sound source. Directivity 20*e* is the direction in which the source is emitting the sound. Reverberation 20*f* indicates whether the environment is highly reverberant, for example a cathedral, or with very weak echoes, such as an outdoor scene. Exaggerated effects 20*g* controls the degree to which changes in source position and velocity alter the gain, reverberation, and Doppler in order to produce more dramatic audio effects, if desired.

Figure 4:
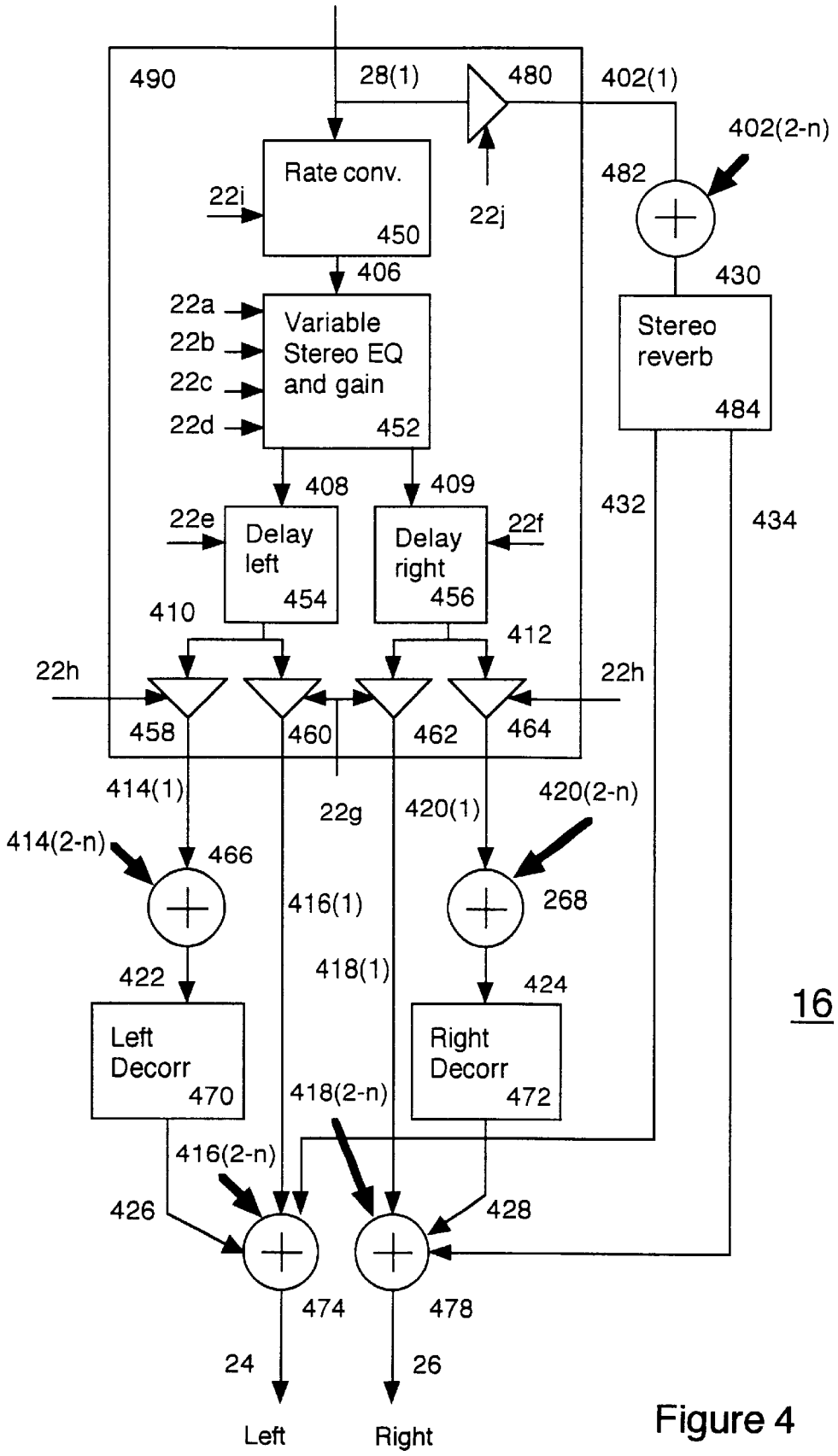
FIG. 4 shows the localization block of FIG. 1.

In the present example, the output parameters 22 include a left equalization gain 22*a*, a right equalization gain 22*b*, a left equalization filter parameter 22*c*, a right equalization filter parameter 22*d*, left delay 22*e*, right delay 22*f*, front parameter 22*g*, back parameter 22*h*, Doppler parameter 22*i*, and reverberation parameter 22*j*. How these parameters are used is shown in FIG. 4. The left and right equalization parameters 22*a–d* control a stereo parametric equalizer (EQ) which models the direction-dependent filtering properties for the left and right ear signals. For example, the gain parameter can be used to adjust the low frequency gain (typically in the band below 5 kHz), while the filter parameter can be used to control the high frequency gain. The left and right delay parameters 22*e–f* adjust the direction-dependent relative delay of the left and right ear signals. Front and back parameters 22*g–h* control the proportion of the left and right ear signals that are sent to a decorrelation system. Doppler parameter 22*i* controls a sample rate converter to simulate Doppler frequency shifts. Reverberation parameter 22*j* adjusts the amount of the input signal that is sent to a shared reverberation system.

Figure 3:
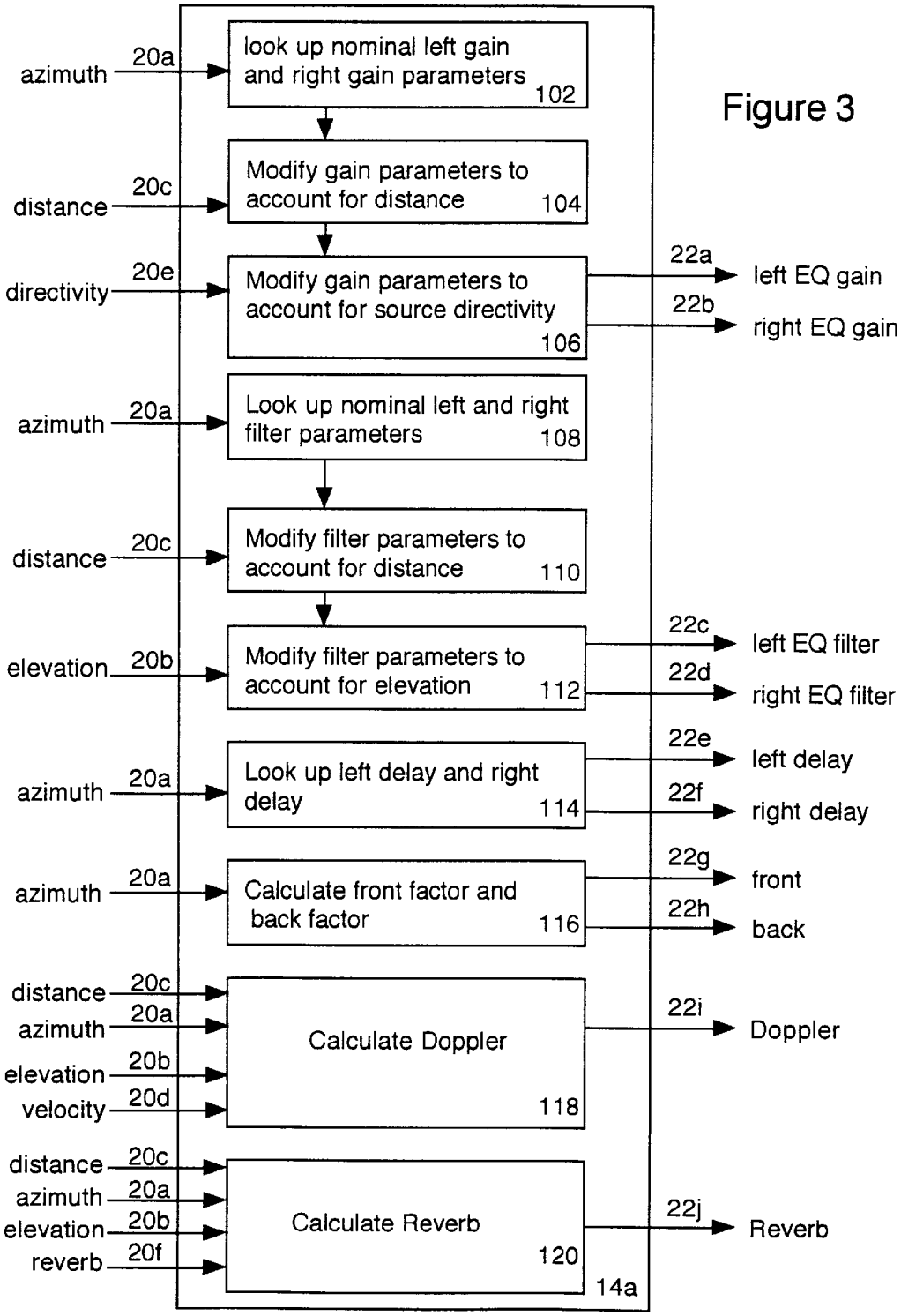
FIG. 3 shows the localization front end blocks of FIGS. 1 and 2 in more detail.

FIG. 3 shows the preferred embodiment of one localization front end block 14*a* in more detail. Azimuth parameter 20*a* is used by block 102 to look up nominal left gain and right gain parameters. These nominal parameters are modified by block 104 to account for distance 20*c*. For example, block 104 might implement the function $G_{R1}=G_{R0}/(\max(1, \text{distance/DMIN}))$, where $G_{R1}$ is the distance modified value of the nominal right gain parameter $G_{R0}$, and DMIN is a minimum distance constant, such as 0.5 meters (and similarly for $G_{L1}$). The modified parameters are passed to block 106, which modifies them further to account for source directivity 20*e*. For example, block 106 might implement the function $G_{R2}=G_{R1}*\text{directivity}$, where directivity is parameter 20*e* and $G_{R2}$ is right EQ gain parameter 22*b* (and similarly for left EQ gain parameter 22*a*). Thus, block 106 generates output parameters left equalization gain 22*a* and right equalization gain 22*b*.

Azimuth parameter 20*a* is also used by block 108 to look up nominal left and right filter parameters. Block 110 modifies the filter parameters according to distance parameter 20*c*. For example, block 110 might implement the function $K_{R1}=K_{R0}/(\max(1,\text{distance/DMINK})$, where $K_{R0}$ is the nominal right filter parameter from a lookup table, and DMINK is a minimum scaling constant such as 0.2 meters (and similarly for $K_{L1}$). Block 112 further modifies the filter parameters according to elevation parameter 20*b*. For example, block 112 might implement the function $K_{R2}=K_{R1}/(1-\sin(el)+Kmax*\sin(el))$, where el is elevation parameter 20*b*, Kmax is the maximum value of K at any azimuth, and $K_{R2}$ is right delay parameter 22*f* (and similarly for $K_{L2}$). Thus, block 114 outputs left delay parameter 22*e* and right delay parameter 22*f*.

Block 114 looks up left delay parameter 22*e* and right delay parameter 22*f* as a function of azimuth parameter 20*a*. The delay parameters account for the interaural arrival time difference as a function of azimuth. In the preferred embodiment, the delay parameters represent the ratio between the required delay and a maximum delay of 32 samples (~726 ms at 44.1 kHz sample rate). The delay is applied to the far ear signal only. Those skilled in the art will appreciate that one relative delay parameter could be specified, rather than left and right delay parameters, if convenient. An example of a delay function based on the Woodworth empirical formula (with azimuth in radians) is:

22*e*=0.3542(azimuth+sin(azimuth)) for azimuth between 0 and π/2;

22*e*=0.3542(π−azimuth+sin(azimuth)) for azimuth between π/2 and π; and

22*e*=0 for azimuth between π and 2π.

22*f*=0.3542(2π−azimuth−sin(azimuth)) for azimuth between 3π/2 and 2π;

22*f*=0.3542(azimuth−π−sin(azimuth)) for azimuth between π and 3π/2; and

22*f*=0 for azimuth between 0 and π.

Block 116 calculates front parameter 22*g* and back parameter 22*h* based upon azimuth parameter 20*a* and elevation parameter 20*b*. Front parameter 22*g* and back parameter 22*h* indicate whether a sound source is in front of or in back of a listener. For example, front parameter 22*g* might be set at one and back parameter 22*h* might be set at zero for azimuths between −110 and 110 degrees; and front parameter 22*g* might be set at zero and back parameter 22*h* might be set at one for azimuths between 110 and 250 degrees for stationary sounds. For moving sounds which cross the plus or minus 110 degree boundary, a transition between zero and one is implemented to avoid audible waveform discontinuities. 22*g* and 22*h* may be computed in real time or stored in a lookup table. An example of a transition function (with azimuth and elevation in degrees) is:

22*g*=1−{115−arccos[cos(azimuth)cos(elevation)]}/15 for azimuths between 100 and 115 degrees, and

22*g*={260−arccos[cos(azimuth)cos(elevation)]}/15 for azimuths between 245 and 260 degrees; and

22*h*=*1*−{255−arccos[cos(azimuth)cos(elevation)]}/15 for azimuths between 240 and 255 degrees, and

22*h*={120−arccos[cos(azimuth)cos(elevation)]}/15 for azimuths between 105 and 120 degrees.

Block 118 calculates doppler parameter 22*i* from distance parameter 20*c*, azimuth parameter 20*a*, elevation parameter 20*b*, and velocity parameter 20*d*. For 5 example, block 118 might implement the function 22*i*=−(x*velocity$_x$+y*velocity$_y$+z*velocity$_z$)/(c*distance), where x, y, and z are the relative coordinates of the source, velocity$_\#$ is the speed of the source in direction #, and c is the speed of sound. c for the particular medium may also be an input to block 118, if greater precision is required.

Block 120 computes reverb parameter 22*j* from distance parameter 20*c*, azimuth parameter 20*a*, elevation parameter 20*b*, and reverb parameter 20*f*. Physical parameters of the simulated space, such as surface dimensions, absorptivity, and room shape, may also be inputs to block 120.

FIG. 4 shows the preferred embodiment of localization block 16 in detail. Note that the functions shown within block 490 are reproduced for each voice. The outputs from block 490 are combined with the outputs of the other blocks 490 as described below. A single voice 28(1) is input into block 490 for individual processing. Voice 28(1) splits and is input into scaler 480, whose gain is controlled by reverberation parameter 22*j* to generate scaled voice signal 402(1). Signal 402(1) is then combined with scaled voice signals 402(2)–**402(*n*) from blocks 490 for the other voices 28(2)–28(*n*) by adder 482. Stereo reverberation block 484 adds reverberation to the scaled and summed voices 430**. The choice of a particular reverberation technique and its control parameters is determined by the available resources in a particular application, and is therefore left unspecified here. A variety of appropriate reverberation techniques are known in the art.

Voice 28(1) is also input into rate conversion block 450, which performs Doppler frequency shifting on input voice 28(1) according to Doppler parameter 22*i*, and outputs rate converted signal 406. The frequency shift is proportional to the simulated radial velocity of the source relative to the listener. The fractional sample rate factor by which the frequency changes is given by the expression 1−$v_r$/c, where $v_r$ is the radial velocity which is a positive quantity for motion away from the listener and a negative quantity for motion toward the listener. c is the speed of sound, approximately 343 m/sec in air at room temperature. In the preferred embodiment, the rate converter function 450 is accomplished using a fractional phase accumulator to which the sample rate factor is added for each sample. The resulting phase index is the location of the next output sample in the input data stream. If the phase accumulator contains a noninteger value, the output sample is generated by interpolating the input data stream. The process is analogous to a wavetable synthesizer with fractional addressing.

Figure 9:
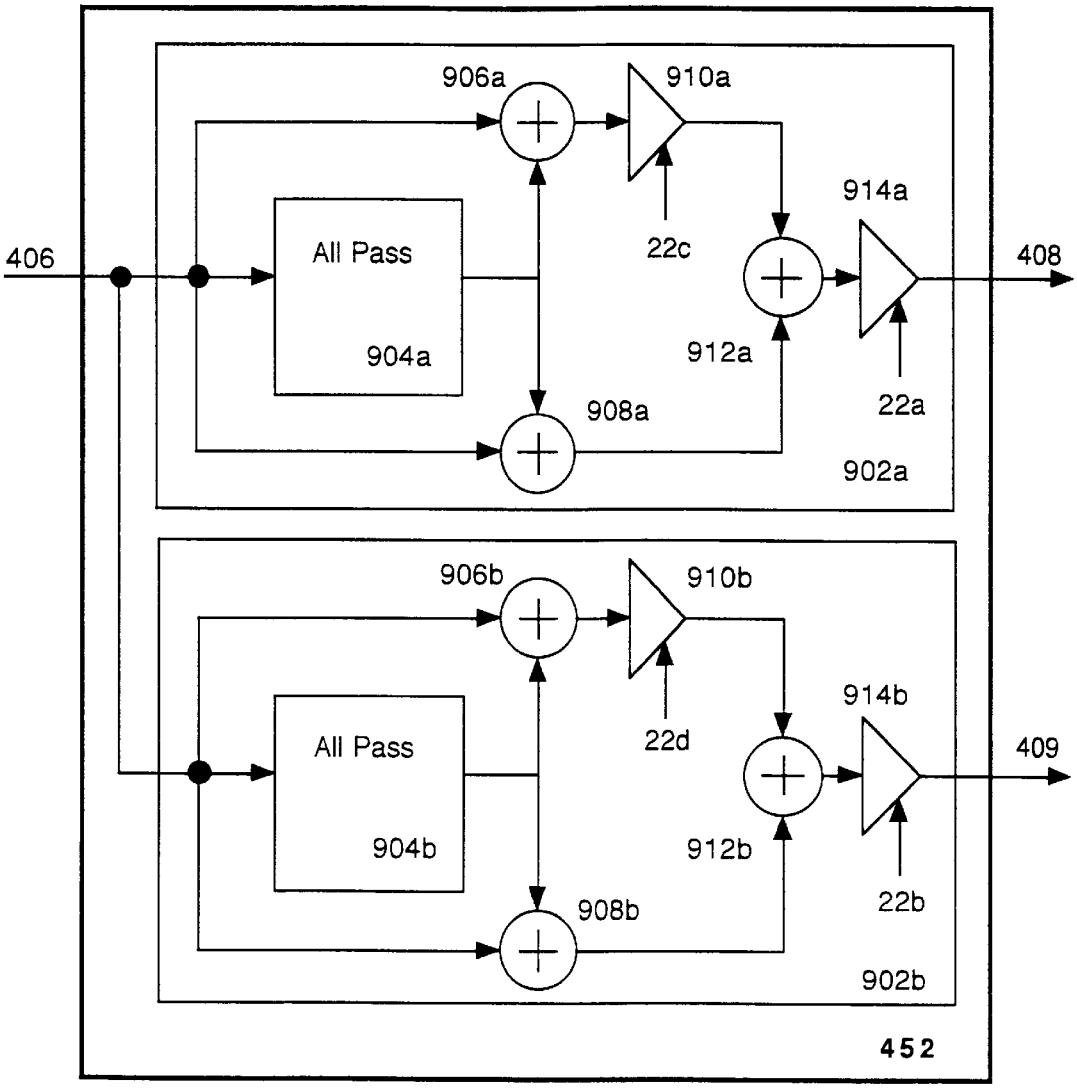
FIG. 9 shows the equalization and gain block of FIG. 4 in more detail.

Rate converted signal 406 is input into variable stereo equalization and gain block 452, whose performance is controlled by left equalization gain 22*a*, right equalization gain 22*b*, left equalization filter parameter 22*c*, and right equalization filter parameter 22*d*. Signal 406 is split and equalized separately to form left and right channels. FIG. 9 shows the preferred embodiment of equalization and gain block 452. Left equalized signal 408 and right equalized signal 409 are handled separately from this point on.

Left equalized signal 408 is delayed by delay left block 454 according to left delay parameter 22*e*, and right equalized signal 409 is delayed by delay right block 456 according to right delay parameter 22*f*. Delay left block 454 and delay right block 456 simulate the interaural time difference between sound arrivals at the left and right ears. In the preferred embodiment, blocks 454 and 456 comprise interpolated delay lines. The maximum interaural delay of approximately 700 microseconds occurs for azimuths of 90 degrees and 270 degrees. This corresponds to less than 32 samples at a 44.1 kHz sample rate. Note that the delay needs to be applied to the far ear signal channel only.

If the required delay is not an integer number of samples, the delay line can be interpolated to estimate the value of the signal between the explicit sample points. The output of blocks 454 and 456 are signals 410 and 412, where one of signals 410 and 412 has been delayed if appropriate.

Signals 410 and 412 are next split and input into scalers 458, 460, 462, and 464. The gains of 458 and 464 are controlled by back parameter 22*h* and the gains of 460 and 462 are controlled by front parameter 22*g*. In the preferred embodiment, either front parameter 22*g* is one and back parameter 22*h* is zero (for a stationary source in front of the listener) or front parameter 22*g* is zero and back parameter 22*h* is one (for a stationary source is in back of the listener), or the front and back parameters transition as a source moves from front to back or back to front. The output of scalar 458 is signal 414(1), the output of scalar 460 is signal 416(1), the output of scalar 462 is signal 418(1) and the output of scalar 464 is signal 420(1). Therefore, either back signals 414(1) and 420(1) are present, or front signals 416(1) and 418(1) are present, or both during transition.

If signals 414(1) and 420(1) are present, then left back signal 414(1) is added to all of the other left back signals 414(2)–**414(*n*) by adder 466 to generate a combined left back signal 422. Left decorrelator 470 decorrelates combined left back signal 422 to produce combined decorrelated left back signal 426. Similarly, right back signal 420(1) is added to all of the other right back signals 420(2)–420(*n*) by adder 268 to generate a combined right back signal 424. Right decorrelator 472 decorrelates combined right back signal 424 to produce combined decorrelated right back signal 428**.

If signals 416(1) and 418(1) are present, then left front signal 416(1) is added to all of the other left front signals 416(2)-416(n) and to the combined decorrelated left back signal 426, as well as left reverb signal 432, by adder 474, to produce left signal 24. Similarly, right front signal 418(1) is added to all of the other right front signals 418(2)–418(*n*) and to the combined decorrelated right back signal 428, as well as right reverb signal 434, by adder 478, to produce right signal 26.

FIG. 9 shows equalization and gain block 452 of FIG. 4 in more detail. The acoustical signal from a sound source arrives at the listener's ears modified by the acoustical effects of the listener's head, body, ear pinnae, and so forth. The resulting source to ear transfer functions are known as head related transfer functions or HRTFs. In this invention, the HRTF frequency responses are approximated using a low order parametric filter. The control parameters of the filter (cutoff frequencies, low and high frequency gains, resonances, etc.) are derived once in advance from actual HRTF measurements using an iterative procedure which minimizes the discrepancy between the actual HRTF and the low order approximation for each desired azimuth and elevation. This low order modeling process is helpful in situations where the available computational resources are limited.

In one embodiment of this invention, the HRTF approximation filter for each ear (blocks 902*a* and 902*b* in FIG. 9) is a first order shelving equalizer of the Regalia and Mitra type. Thus the function of the equalizers of blocks 904*a* and b has the form of an all pass filter:

$$F(z) = \frac{-b - z^{-1}}{1 + bz^{-1}}, \left\{ b = -\cos\left(\frac{\pi f_{cut}}{f_s/2}\right) \right\},$$

where $f_s$ is the sampling frequency, $f_{cut}$ is frequency desired for the high frequency boost or cut, and $z^{-1}$ indicates a unit sample delay. Signal 406 is fed into equalization blocks 902*a* and b. In block 902*a*, signal 406 is split into three branches, one of which is fed into equalizer 904*a*, and a second of which is added to the output of 902*a* by adder 906*a* and has a gain applied to it by scaler 910*a*. The gain applied by scaler 910*a* is controlled by signal 22*c*, the left equalization filter parameter from localization front end block 14. The third branch is added to the output of block 904*a* and added to the second branch by adder 912*a*. The output of adder 912*a* has a gain applied to it by scaler 914*a*. The gain applied by scaler 914*a* is controlled by signal 22*a*, the left equalization gain parameter from localization front end block 14.

Similarly, in block 902*b*, signal 406 is split into three branches, one of which is fed into equalizer 904*b*, and a second of which is added to the output of 902*b* by adder 906*b* and has a gain applied to it by scaler 910*b*. The gain applied by scaler 910*b* is controlled by signal 22*d*, the right equalization filter parameter from localization front end block 14. The third branch is added to the output of block 904*b* and added to the second branch by adder 912*b*. The output of adder 912*b* has a gain applied to it by scaler 914*b*. The gain applied by scaler 914*b* is controlled by signal 22*b*, the right equalization gain parameter from localization front end block 14. The output of block 902*b* is signal 409.

In this manner blocks 902*a* and 902*b* perform a low-order HRTF approximation by means of parametric equalizers.

Figure 5:
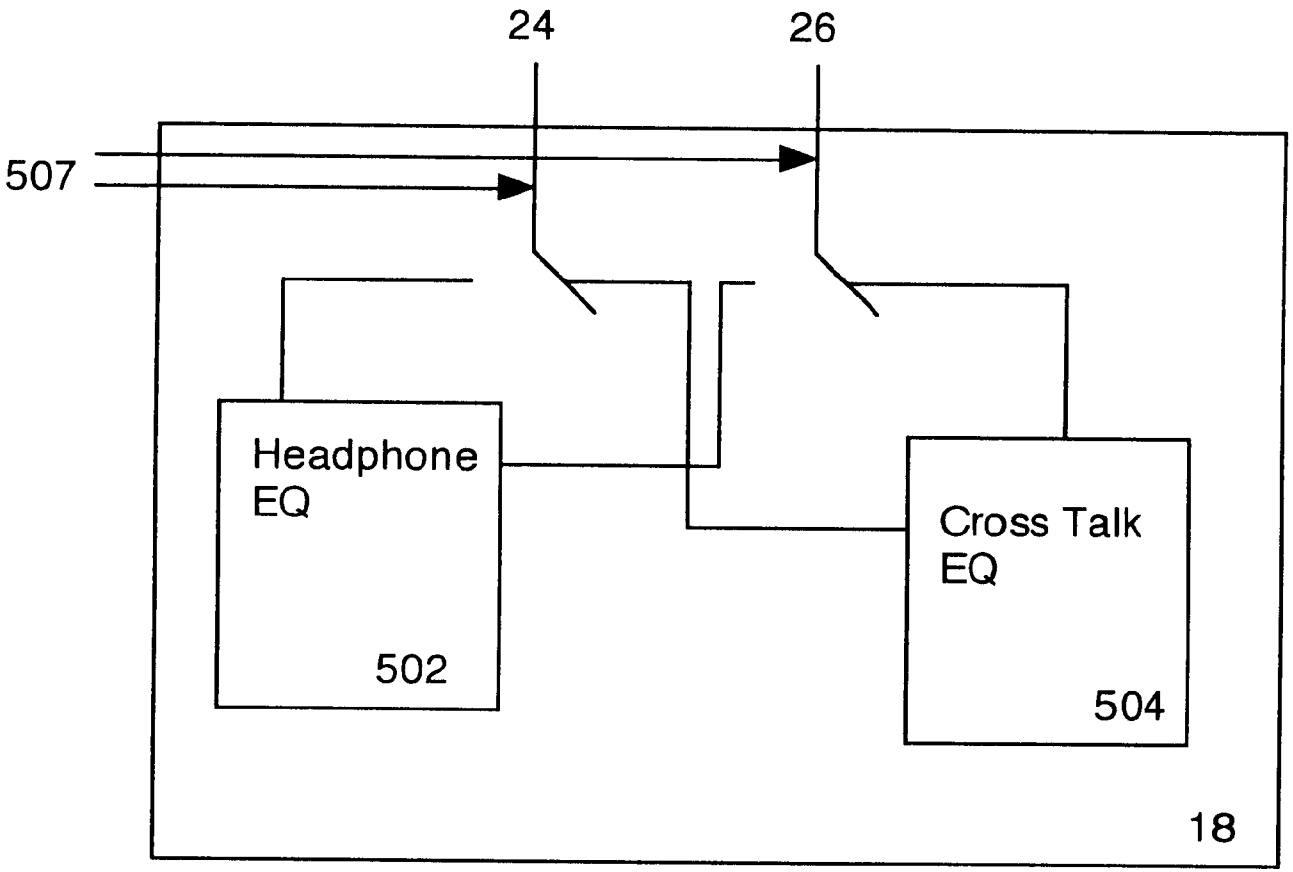
FIG. 5 shows the output signals of the localization block of FIG. 1 and 4 routed to either headphones or speakers.
Figure 8:
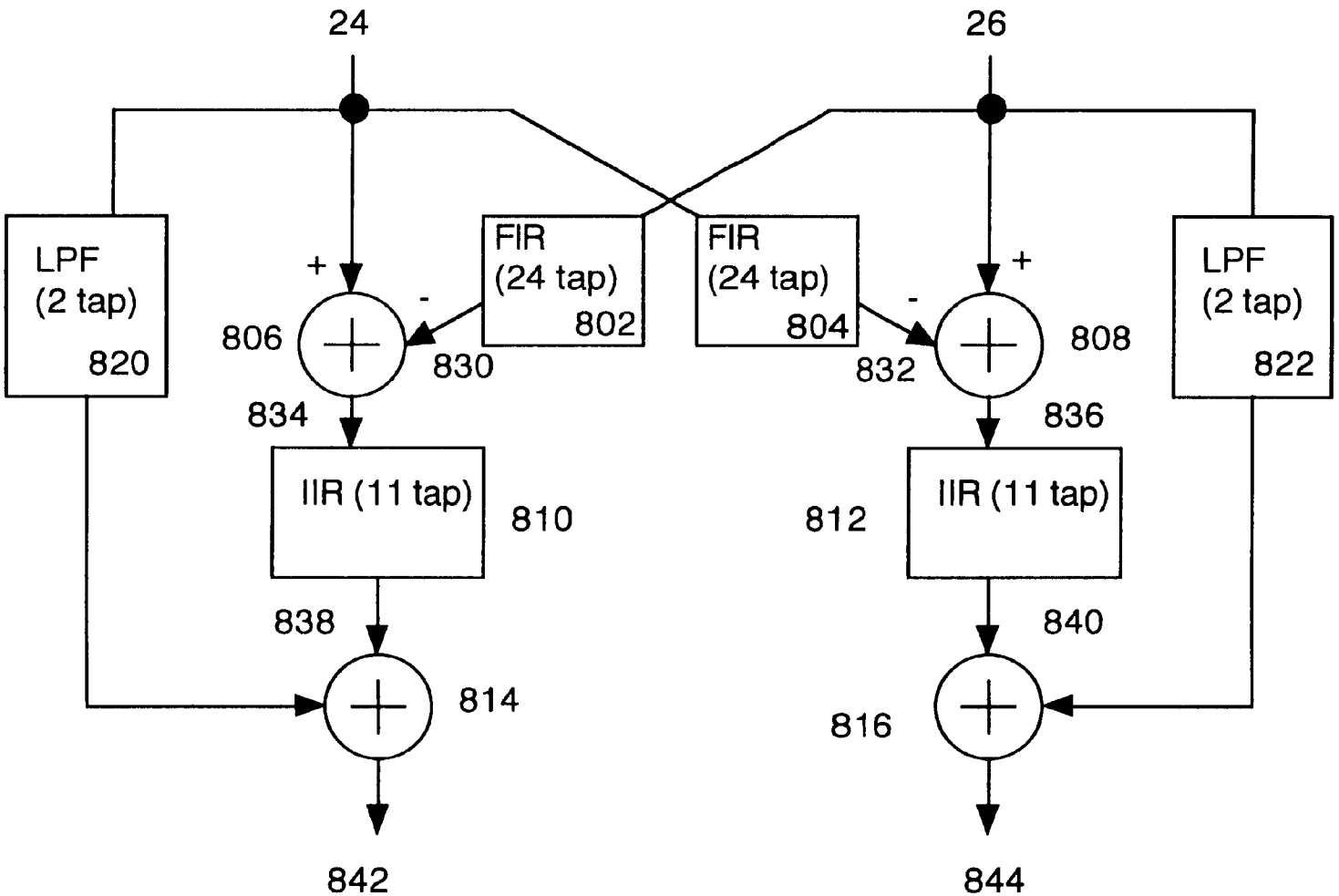
FIG. 8 shows the crosstalk cancellation (CTC) scheme of the present invention, which comprises the CTC block of FIG. 5.

FIG. 5 shows output signals 24 and 25 of localization block 16 of FIGS. 1 and 4 routed to either headphone equalization block 502 or speaker equalization block 504. Left signal 24 and right signal 26 are routed according to control signal 507. Headphone equalization is well understood and is not described in detail here. A new crosstalk cancellation (or compensation) scheme 504 for use with loudspeakers is shown in FIG. 8.

Figure 6:
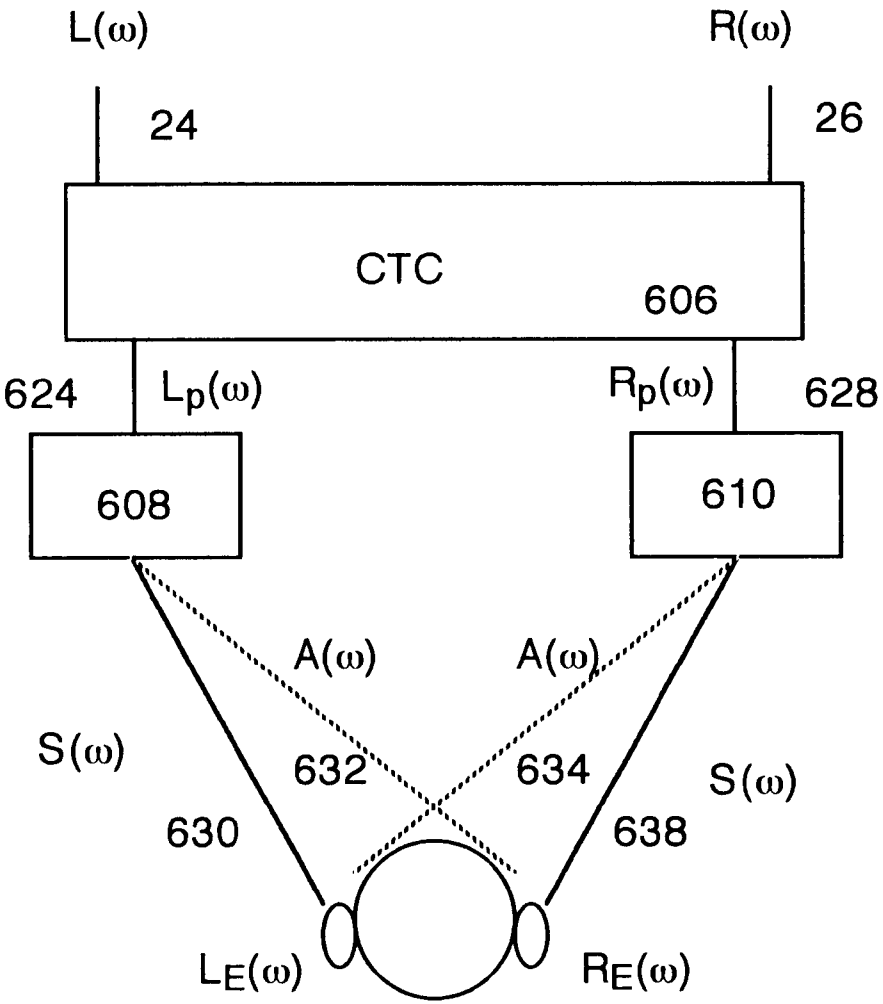
FIG. 6 shows crosstalk between two loudspeakers and a listener's ears.

FIG. 6 shows crosstalk between two loudspeakers 608 and 610 and a listener's ears 612 and 618, which is corrected by crosstalk compensation (CTC) block 606. The primary problem with loudspeaker reproduction of directional audio effects is crosstalk between the loudspeakers and the listener's ears. Left channel 24 and right channel 26 from localization device 16 are processed by CTC block 606 to produce right CTC signal 624 and left CTC signal 628.

S(ω) is the transfer function from a speaker to the same side ear, and A(ω) is the transfer function from a speaker to the opposite side ear, both of which include the effects of speaker 608 or 610. Thus, left loudspeaker 608 is driven by $L_P(\omega)$, producing signal 630 which is amplified signal 624 operated on by transfer function S(ω) before being received by left ear 612; and signal 632, which is amplified signal 624 operated on by transfer function A(ω) before being received by right ear 618. Similarly, right loudspeaker 610 is driven by $R_P(\omega)$, producing signal 638 which is amplified signal 628 operated on by transfer function S(ω) before being received by right ear 618; and signal 634, which is amplified signal 628 operated on by transfer function A(ω) before being received by left ear 612.

Delivering only the left audio channel to the left ear and the right audio channel to the right ear requires the use of either headphones or the inclusion of a crosstalk cancellation (CTC) system 606 to approximate the headphone conditions. The principle of CTC is to generate signals in the audio stream that will acoustically cancel the crosstalk components at the position of the listener's ears. U.S. Pat. No. 3,236,949, by Schroeder and Atal, describes one well known CTC scheme.

Figure 7:
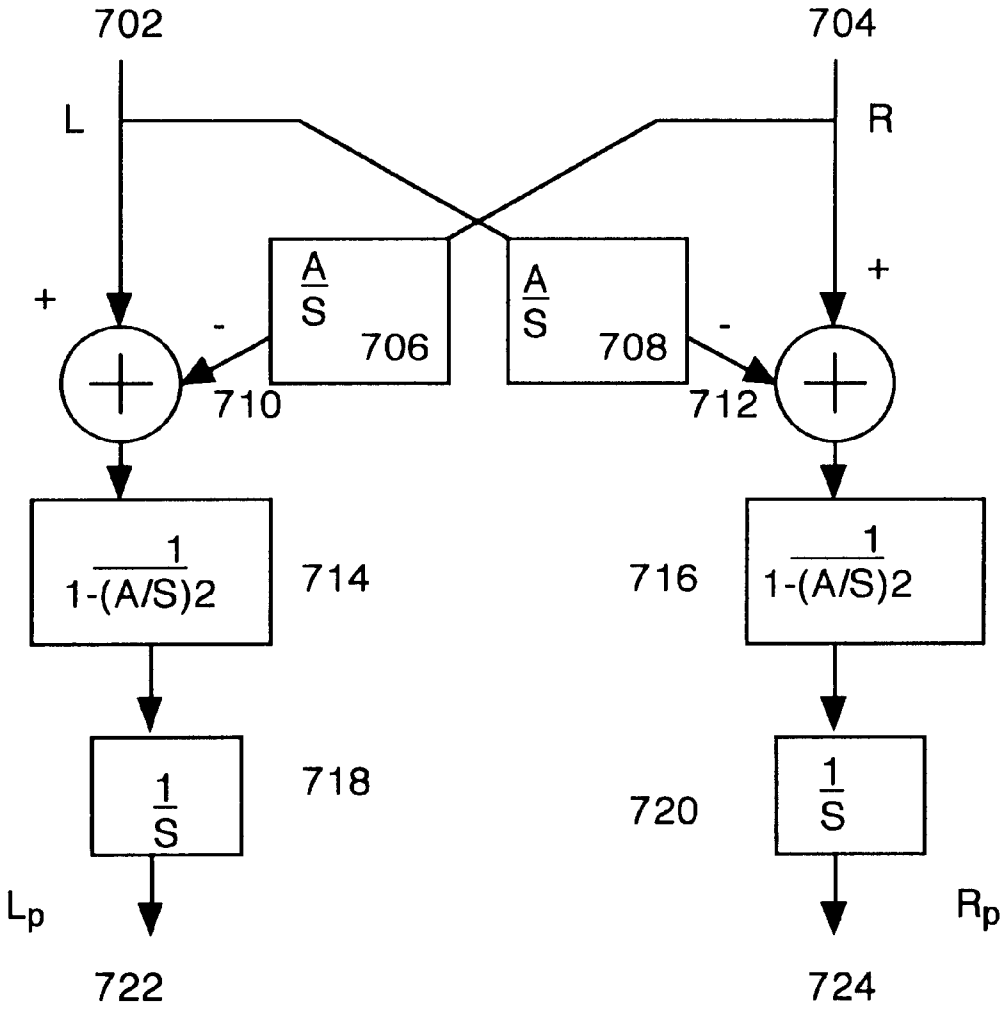
Figure 7 (prior art)
FIG. 7 (prior art) shows the Schroeder-Atal crosstalk cancellation (CTC) scheme.

FIG. 7 (prior art) shows the Schroeder-Atal crosstalk cancellation (CTC) scheme. The mathematical development of the Schroeder-Atal CTC system is as follows. The total acoustic spectral domain signal at each ear is given by $$L_E(\omega)=S(\omega)\cdot L_P(\omega)+A(\omega)\cdot R_P(\omega)$$

$$R_E(\omega)=S(\omega)\cdot R_P(\omega)+A(\omega)\cdot L_P(\omega),$$

where $L_E(\omega)$ and $R_E(\omega)$ are the signals at the left ear (630+634) and at the right ear (634+638) and $L_P(\omega)$ and $R_P(\omega)$ are the left and right speaker signals. S(ω) is the transfer function from a speaker to the same side ear, and A(ω) is the transfer function from a speaker to the opposite side ear. Note that S(ω) and A(ω) are the head related transfer functions corresponding to the particular azimuth, elevation, and distance of the loudspeakers relative to the listener's ears. These transfer functions take into account the diffraction of the sound around the listener's head and body, as well as any spectral properties of the loudspeakers.

The desired result is to have $L_E$=L and $R_E$=R. Through a series of mathematical steps shown in the patent referenced above (U.S. Pat. No. 3,236,949), the Schroeder-Atal CTC block would be required to be of the form shown in FIG. 7. Thus L (702) passes through block 708, implementing A/S, to be added to R (704) by adder 712. This result is filtered by the function shown in block 716, and then by the function 1/S shown in block 720. The result is $R_P$(724). Similarly, R (704) passes through block 706, implementing A/S, to be added to L (702) by adder 710. This result is filtered by the function shown in block 714, and then by the function 1/S shown in block 718. The result is $L_P$(722).

The raw computational requirements of the full-blown Schroeder-Atal CTC network are too high for most practical systems. Thus, the following simplifications are utilized in the CTC device shown in FIG. 8. Left signal 24 and right signal 26 are the inputs, equivalent to 702 and 704 in FIG. 7.

1) The function S is assumed to be a frequency-independent delay. This eliminates the need for the 1/S blocks 718 and 720, since these blocks amount to simply advancing each channel signal by the same amount.
2) The function A (A/S in the Schroeder-Atal scheme) is assumed to be a simplified version of a contralateral HRTF, reduced to a 24-tap FIR filter, implemented in blocks 802 and 804 to produce signals 830 and 832, which are added to signals 24 and 26 by adders 806 and 808 to produce signals 834 and 836. The simplified 24-tap FIR filters retain the HRTF's frequency behavior near 10 kHz, as shown in FIG. 10.
3) The recursive functions (blocks 714 and 716 in FIG. 7) are implemented as simplified 25-tap IIR filters, of which 14 taps are zero (11 true taps) in blocks 810 and 812, which output signals 838 and 840.
4) The resulting output was found subjectively to be bass deficient, so bass bypass filters (2nd order LPF, blocks 820 and 822) are applied to input signals 24 and 26 and added to each channel by adders 814 and 816.

Outputs 842 and 844 are provided to speakers (not shown).

Figure 10:
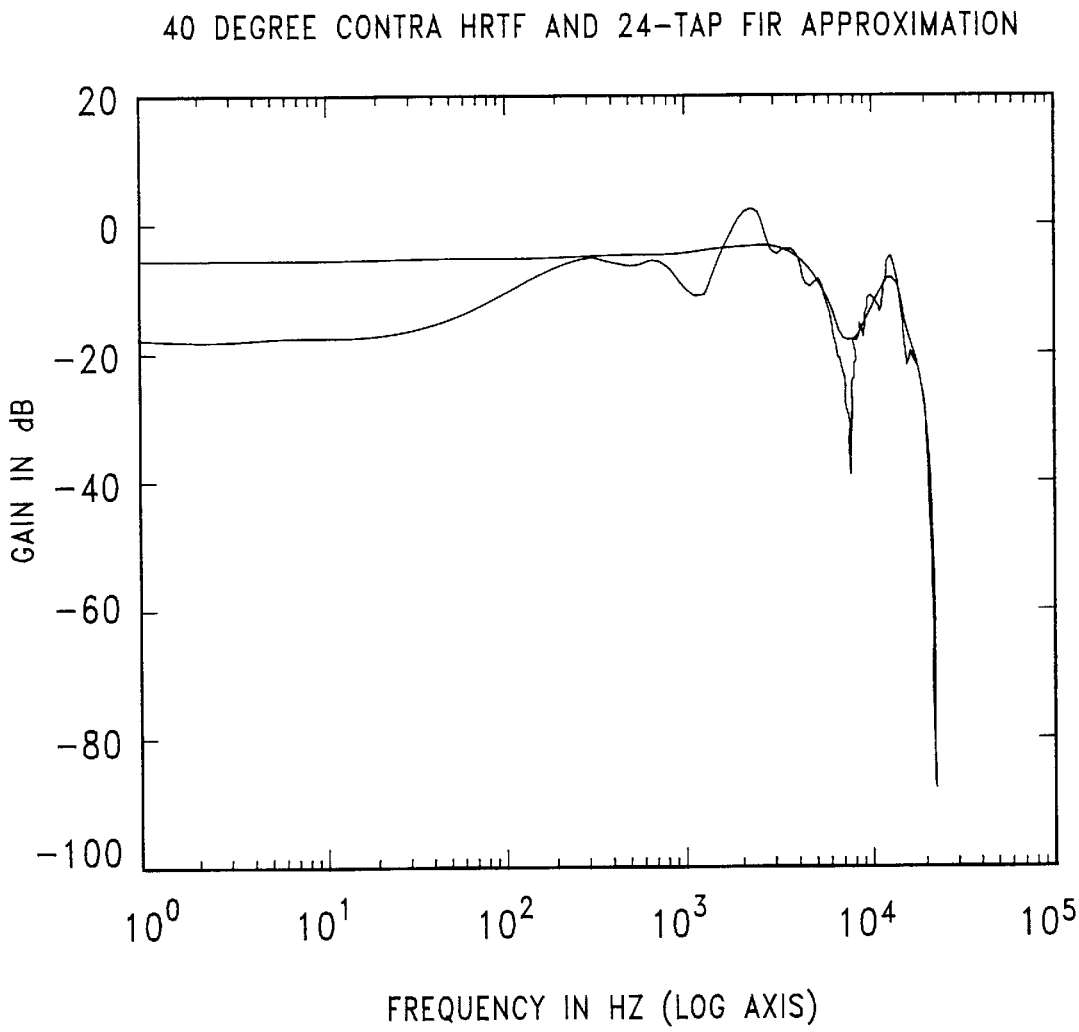
FIG. 10 shows the frequency response of the FIR filters of FIG. 8 compared to the true HRTF frequency response.

FIG. 10 shows the frequency response of the filters of blocks 802 and 804 (FIG. 8) compared to the true HRTF frequency response. The filters of blocks 802 and 804 retain the HRTF's frequency behavior near 10 kHz, which is important for broadband, high fidelity applications. The group delay of these filters are 12 samples, corresponding to about 270 msec, or about 0.1 meters at 44.1 kHz sample rate. This is approximately the interaural difference for loudspeakers located at plus and minus 40 degrees relative to the listener.

While the exemplary preferred embodiments of the present invention are described herein with particularity, those skilled in the art will appreciate various changes, additions, and applications other than those specifically mentioned, which are within the spirit of this invention.

What is claimed is:

1. Audio spatial localization apparatus for generating a stereo signal which simulates the acoustical effect of a plurality of localized sounds, said apparatus comprising:

means for providing an audio signal representing each sound;

means for separating each audio signal into left and right channels;

means for providing a set of input parameters representing the desired physical and geometrical attributes of each sound;

front end means for generating a set of control parameters based upon each set of input parameters, including control parameters for affecting time alignment of the channels, fundamental frequency, and frequency spectrum, for each audio signal:

voice processing means for separately modifying interaural time alignment, fundamental frequency, and frequency spectrum of each audio signal according to its associated set of control parameters to produce a voice signal which simulates the effect of the associated sound with the desired physical and geometrical attributes;

means for combining the voice signals to produce an output stereo signal including a left channel and a right channel; and crosstalk cancellation apparatus for modifying the stereo signal to account for crosstalk, said crosstalk cancellation apparatus including— means for splitting the left channel of the stereo signal into a left direct channel, a left cross channel and a third left channel;

means for splitting the right channel of the stereo signal into a right direct channel, a right cross channel, and a third right channel;

nonrecursive left cross filter means for delaying, inverting, and equalizing the left cross channel to cancel initial acoustic crosstalk in the right direct channel;

nonrecursive right cross filter means for delaying, inverting, and equalizing the right cross channel to cancel initial acoustic crosstalk in the left direct channel;

means for summing the right direct channel and the left cross channel to form a right output channel; and means for summing the left direct channel and the right cross channel to form a left output channel;

means for low pass filtering the third left channel;

means for low pass filtering the third right channel;

means for summing the low pass filtered left channel with the left output channel; and means for summing the low pass filtered right channel with the right output channel.

2. The apparatus of claim 1, wherein said left direct channel filter means and said right direct channel filter means comprise recursive filters.

3. The apparatus of claim 2, wherein said left direct channel filter means and said right direct channel filter means comprise IIR filters.

4. Audio spatial localization apparatus for generating a stereo signal which simulates the acoustical effect of a localized sound, said apparatus comprising:

means for providing an audio signal representing the sound;

means for providing parameters representing the desired physical and geometrical attributes of the sound;

means for modifying the audio signal according to the parameters to produce a stereo signal including a left channel and a right channel, said stereo signal simulating the effect of the sound with the desired physical and geometrical attributes; and crosstalk cancellation apparatus for modifying the stereo signal to account for crosstalk, said crosstalk cancellation apparatus including:

means for splitting the left channel of the stereo signal into a left direct channel, a left cross channel, and a left bypass channel;

means for splitting the right channel of the stereo signal into a right direct channel, a right cross channel, and a right bypass channel;

nonrecursive left cross filter means for delaying, inverting, and equalizing the left cross channel to cancel initial accoustic crosstalk in the right direct channel;

nonrecursive right cross filter means for delaying, inverting, and equalizing the right cross channel to cancel initial accoustic crosstalk in the left direct channel;

means for summing the right direct channel and the left cross channel to form a right initial-crosstalk-canceled channel;

means for summing the left direct channel and the right cross channel to form a left initial-crosstalk-canceled channel;

means for low pass filtering the left bypass channel;

means for low pass filtering the right bypass channel;

means for summing the low pass filtered left bypass channel with the left output channel; and means for summing the low pass filtered right bypass channel with the right output channel.

5. The apparatus of claim 4, wherein said nonrecursive left cross filter means and said nonrecursive right cross filter means comprise FIR filters.

6. The apparatus of claim 4, further comprising:

left direct channel filter means for canceling subsequent delayed replicas of crosstalk in the left initial-crosstalk-canceled channel to form a left output channel; and right direct channel filter means for canceling subsequent delayed replicas of crosstalk in the right initial-crosstalk-canceled channel to form a right output channel.

7. The apparatus of claim 6, wherein said left direct channel filter means and said right direct channel filter means comprise recursive filters.

8. The apparatus of claim 7, wherein said left direct channel filter means and said right direct channel filter means comprise IIR filters.

9. Audio spatial localization apparatus for generating a stereo signal which simulates the acoustical effect of a plurality of localized sounds, said apparatus comprising:

means for providing an audio signal representing each sound;

means for providing a set of input parameters representing the desired physical and geometrical attributes of each sound;

front end means for generating a set of control parameters based upon each set of input parameters, including a front parameter and a back parameter;

voice processing means for modifying each audio signal according to its associated set of control parameters to produce a voice signal having a left channel and a right channel which simulates the effect of the associated sound with the desired physical and geometrical attributes;

means for separating each left channel into a left front and a left back channel;

means for separating each right channel into a right front and a right back channel;

means for applying gains to the left front, left back, right front, and right back channels according to the front and back control parameters;

means for combining all of the left back channels for all of the voices and decorrelating them;

means for combining all of the right back channels for all of the voices and decorrelating them;

means for combining all of the left front channels with the decorrelated left back channels to form a left output signal;

means for combining all of the right front channels with the decorrelated right back channels to form a right output signal; and crosstalk cancellation apparatus for modifying the stereo signal to account for crosstalk, said crosstalk cancellation apparatus including— means for splitting the left channel of the stereo signal into a left direct channel, a left cross channel, and a third left channel;

means for splitting the right channel of the stereo signal into a right direct channel, a right cross channel, and a third right channel;

nonrecursive left cross filter means for delaying, inverting, and equalizing the left cross channel to cancel initial acoustic crosstalk in the right direct channel;

nonrecursive right cross filter means for delaying, inverting, and equalizing the right cross channel to cancel initial acoustic crosstalk in the left direct channel;

means for summing the right direct channel and the left cross channel to form a right initial-crosstalk-canceled channel;

means for summing the left direct channel and the right cross channel to form a left initial-crosstalk-canceled channel;

left direct channel filter means for canceling subsequent delayed replicas of crosstalk in the left initial-crosstalk-canceled channel to form a left output channel;

right direct channel filter means for canceling subsequent delayed replicas of crosstalk in the right initial-crosstalk-canceled channel to form a right output channel;

means for additionally splitting the left channel into a third left channel;

means for low pass filtering the third left channel;

means for low pass filtering the third right channel;

means for summing the low pass filtered left channel with the left output channel; and means for summing the low pass filtered right channel with the right output channel.

10. The apparatus of claim 9, wherein said left direct channel filter means and said right direct channel filter means comprise recursive filters.

11. The apparatus of claim 10, wherein said left direct channel filter means and said right direct channel filter means comprise IIR filters.

12. Crosstalk cancellation apparatus comprising:

means for providing a left audio channel;

means for splitting the left channel into a left direct channel, a left cross channel, and a left bypass channel;

means for providing a right audio channel;

means for splitting the right channel into a right direct channel, a right cross channel, and a right cross channel;

nonrecursive left cross filter means for delaying, inverting, and equalizing the left cross channel to cancel initial accoustic crosstalk in the right direct channel;

nonrecursive right cross filter means for delaying, inverting, and equalizing the right cross channel to cancel initial accoustic crosstalk in the left direct channel;

means for summing the right direct channel and the left cross channel to form a right initial-crosstalk-canceled channel;

means for summing the left direct channel and the right cross channel to form a left initial-crosstalk-canceled channel;

means for low pass filtering the left bypass channel;

means for low pass filtering the right bypass channel;

means for summing the low pass filtered left bypass channel with the left initial-crosstalk-canceled channel to form a left output channel; and means for summing the low pass filtered right bypass channel with the right initial-crosstalk-canceled channel to form a right output channel.

13. The apparatus of claim 12, wherein said nonrecursive left cross filter means and said nonrecursive right cross filter means comprise FIR filters.

14. The apparatus of claim 12, further comprising:

left direct channel filter means for canceling subsequent delayed replicas of crosstalk in the left initial-crosstalk-canceled channel; and right direct channel filter means for canceling subsequent delayed replicas of crosstalk in the right initial-crosstalk-canceled channel.

15. The apparatus of claim 14, wherein said left direct channel filter means and said right direct channel filter means comprise recursive filters.

16. The apparatus of claim 15, wherein said left direct channel filter means and said right direct channel filter means comprise IIR filters.

* * * * *

UNITED STATES PATENT AND TRADEMARK OFFICE

CERTIFICATE OF CORRECTION

PATENT NO. : 6,078,669

DATED : June 20, 2000

INVENTOR(S) : Rob Maher

It is certified that error appears in the above-identified patent and that said Letters Patent is hereby corrected as shown below:

Column 7, line 36, between 'For' and 'example' delete "5".

Column11, line 57, after 'signal' delete ":" and insert --; --.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*